US007093643B2

(12) United States Patent
Ikle

(10) Patent No.: US 7,093,643 B2
(45) **Date of Patent: *Aug. 22, 2006**

(54) ENERGY SAVING WINDOW SHADE SYSTEM

(76) Inventor: Doris M. Ikle, 7010 Glenbrook Rd., Bethesda, MD (US) 20814

( * ) Notice: Subject to any disclaimer, the term of this patent is extended or adjusted under 35 U.S.C. 154(b) by 0 days.

This patent is subject to a terminal disclaimer.

(21) Appl. No.: 10/736,992

(22) Filed: Dec. 17, 2003

(65) Prior Publication Data

US 2004/0221967 A1 Nov. 11, 2004

Related U.S. Application Data

(63) Continuation of application No. 10/058,992, filed on Jan. 30, 2002, now Pat. No. 6,666,251.

(60) Provisional application No. 60/265,526, filed on Jan. 31, 2001, provisional application No. 60/296,131, filed on Jun. 7, 2001.

(51) Int. Cl.
*E06B 9/40* (2006.01)

(52) U.S. Cl. ..... 160/120; 160/271

(58) Field of Classification Search ..... 160/120, 160/270, 271, 272, 273.1, 23.1, 11, 41, 31, 160/323.1; 248/269, 270, 271, 272
See application file for complete search history.

(56) References Cited

U.S. PATENT DOCUMENTS 1,491,919 A * 4/1924 Nutter ..... 248/271
1,855,010 A * 4/1932 Coleman ..... 248/271
2,041,105 A 5/1936 Barnhart
3,990,635 A 11/1976 Restle et al.
4,020,889 A 5/1977 Karoll
4,323,105 A 4/1982 Berman et al.
4,344,474 A 8/1982 Berman
4,357,978 A * 11/1982 Keller et al. ..... 160/41
4,369,829 A 1/1983 Casiday
4,398,585 A 8/1983 Marlow
4,433,712 A 2/1984 Mellon et al.
4,463,792 A 8/1984 Lukos
4,574,861 A 3/1986 Mao
4,597,430 A * 7/1986 Marquez ..... 160/269
4,610,292 A 9/1986 Hausmann et al.
4,610,293 A 9/1986 Weiblen (Continued)

*Primary Examiner*—David Purol
(74) *Attorney, Agent, or Firm*—Finnegan, Henderson, Farabow, Garrett, and Dunner, L.L.P.

(57) ABSTRACT

An energy saving shade system for residential dwelling windows having dimensions that vary within a range of frame widths and a range of frame heights, and including a pair of end caps, each being insertable in sealing relation against the top surface and one of the side surfaces of the frame. A pair of side rails, each having a cross-section to define channel openings of a depth equal to at least one half the range of frame widths are securable in sealing relation to respective side surfaces of the frame. A pair of shade supporting plates are receivable in the respective end caps, each of the shade supporting plates being laterally adjustable throughout approximately one half the range of frame widths. An impermeable, transparent shade and a thermal insulating shade of widths within the range of frame widths are wound on rollers mountable between the shade supporting plates, and extendible for the range of frame heights from the roller to the sill. Edge seals are provided in the channels of the respective side rails, for slidably engaging and retaining opposite sides of the respective shade members in spaced relation to a window pane and end seals are provided between the top and bottom of at least the transparent shade.

23 Claims, 4 Drawing Sheets

U.S. PATENT DOCUMENTS 4,766,941 A 8/1988 Sloop et al.
4,784,215 A 11/1988 Sing
4,907,636 A 3/1990 Simon
4,986,343 A 1/1991 Sing
5,083,601 A * 1/1992 Tedeschi ..... 160/323.1
5,117,891 A 6/1992 Simon
5,413,161 A 5/1995 Corazzini
5,419,385 A 5/1995 Vogel et al.
5,566,736 A 10/1996 Crider et al.
5,735,328 A 4/1998 Salhoff et al.
5,868,191 A 2/1999 Blackmon, Jr.
6,070,639 A 6/2000 Winston et al.
6,666,251 B1 * 12/2003 Ikle ..... 160/120

* cited by examiner

ENERGY SAVING WINDOW SHADE SYSTEM

CROSS REFERENCE TO RELATED APPLICATIONS

This is a continuation of application Ser. No. 10/058,992, filed Jan. 30, 2002, now U.S. Pat. No. 6,666,251 B2, and claims the benefit of U.S. provisional application No. 60/265,526, filed Jan. 31, 2001 and U.S. provisional application No. 60/296,131, filed Jun. 7, 2001, all of which are incorporated herein by reference.

BACKGROUND OF THE INVENTION

This invention relates to an energy saving shade system for windows of residential dwellings, and, more particular, to such shade systems that are energy efficient, both to conserve heat when the dwelling is heated, to conserve energy when the dwelling is cooled, and that are aesthetically attractive and easily installed in windows of various sizes.

Various thermal shade systems have been proposed to reduce heat transfer through windows of residential dwellings. Typically, such shade systems have involved a shade position to be spaced from the pane or panes of the window, and sealed about the periphery of the window frame to provide a dead air space between the shade and the window pane or panes. Although the dead air space, in itself, provides an efficient barrier to heat transfer through the window, thermal insulating shade systems have not enjoyed significant commercial acceptance, either because labor intensive cost of installation in windows of varying dimensions, the availability in the past of low cost heating and cooling energy, lack of acceptable decorating characteristics, or a combination of these factors and others.

Thus, there is a need for improvement in energy shade systems for residential dwelling windows.

SUMMARY OF THE INVENTION

The advantages and purpose of the invention will be set forth in part in the description which follows, and in part will be obvious from the description, or may be learned by practice of the invention. The advantages and purpose of the invention will be realized and attained by means of the elements and combinations particularly pointed out in the appended claims.

To attain the advantages and in accordance with the purpose of the invention, as embodied and broadly described herein, the invention is directed to an energy saving shade system for residential dwelling windows, each window having a window pane and a rectangular frame defined by top, side, and sill surfaces, the frame of each window having dimensions that vary from those of at least one other of the windows within a range of frame widths and a range of frame heights. The shade system comprises a pair of end caps, each having a side wall, a top wall, a front wall, a bottom wall, and a back wall, the top, front and back walls projecting in a normal direction from the side wall, at least the front wall so projecting by at least one half the range of frame widths. Each of the pair of end caps is insertable in sealing relation against the top surface and one of the side surfaces of the frame. A pair of side rails, each having a cross-section to provide a base, and a pair of generally parallel walls projecting from the base by at least one half the range of frame widths to define at least one channel opening inwardly of the respective side surfaces of the frame, are securable in sealing relation to the respective side surfaces of the frame. The side rails have lengths adjustable through the range of frame heights and to extend between sill and the end caps. A pair of shade supporting plates are receivable in the respective end caps, each of the shade supporting plates being laterally adjustable throughout approximately one half the range of frame widths. An impermeable, transparent shade of a width within the range of frame widths, has a top portion connected to and wound on a roller mountable between the shade supporting plates, and a bottom end extendible for the range of frame heights from the roller to the sill. A pair of edge seals are supported within the at least one channel of the respective side rails, for slidably engaging and retaining opposite sides of the shade member in spaced relation to the window pane. The system also includes means for sealing the transparent shade and the top surface of the rectangular frame and means for sealing the distal end of the transparent shade and the sill.

The shade system of the invention also includes a thermal insulating shade and a valance to extend between the end caps and having a length to overlie at least a portion of the front walls of the end caps in the widest of the range of frame widths and not exceeding the narrowest of the range of frame widths. The thermal insulating shade is of a width within the range of frame widths, and has top, bottom, and side edge portions, the top portion of the thermal insulating shade being connected to a second roller mountable between the shade supporting plates, and being wound on the second roller in a retracted condition. The bottom portion of the thermal insulating shade is extendable from the second roller to the sill surface of the rectangular frame to position the thermal insulating shade in substantially parallel spaced relation to the transparent shade.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate an exemplary embodiment of the invention and together with the description, serve to explain the principles of the invention. In the drawings.

DESCRIPTION OF THE PREFERRED EMBODIMENT

Reference will now be made in detail to an exemplary embodiment of the invention, an example of which is illustrated in the accompanying drawings. Wherever possible, the same reference numbers will be used throughout the drawings to refer to the same or like parts.

In accordance with the present invention, an energy saving shade system is provided for residential dwelling windows, each window having a window pane and a rectangular frame, the frame of each window having dimensions that vary from those of at least one other of the windows within a range of frame widths and a range of frame heights. The shade system comprises a pair of end caps, insertable in sealing relation against the top and the side surfaces of the frame. A pair of side rails define at least one channel opening to face inwardly of the respective side surfaces of the frame, are securable in sealing relation to the respective side surfaces of the frame, and have lengths adjustable through the range of frame heights to extend between the window sill and the end caps. A pair of shade supporting plates are receivable in the respective end caps so that each of the shade supporting plates is laterally adjustable throughout approximately one half the range of frame widths.

Figure 1:
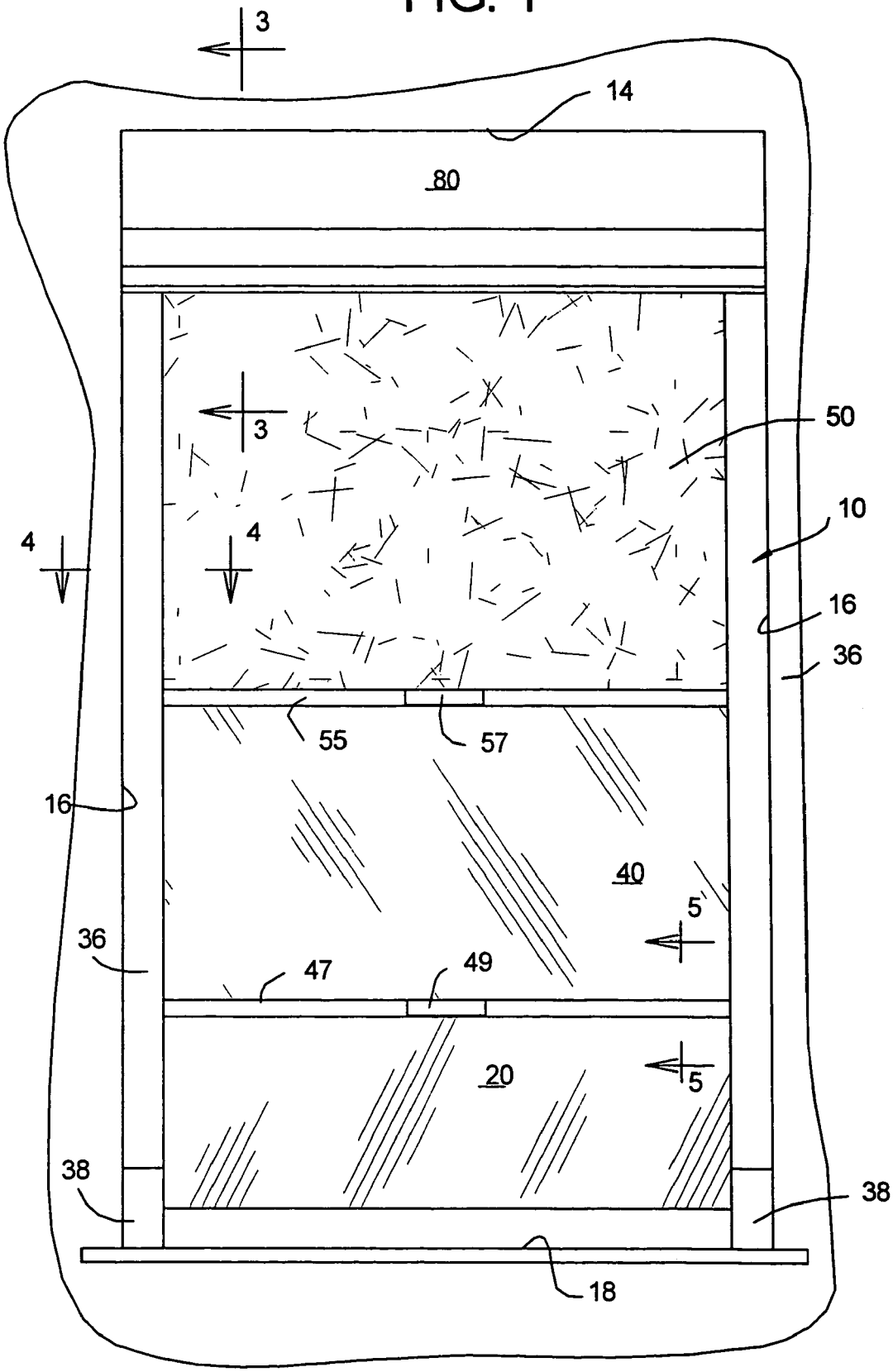
FIG. 1 is a front elevation showing the shade system of the present invention in a residential dwelling window.
Figure 2:
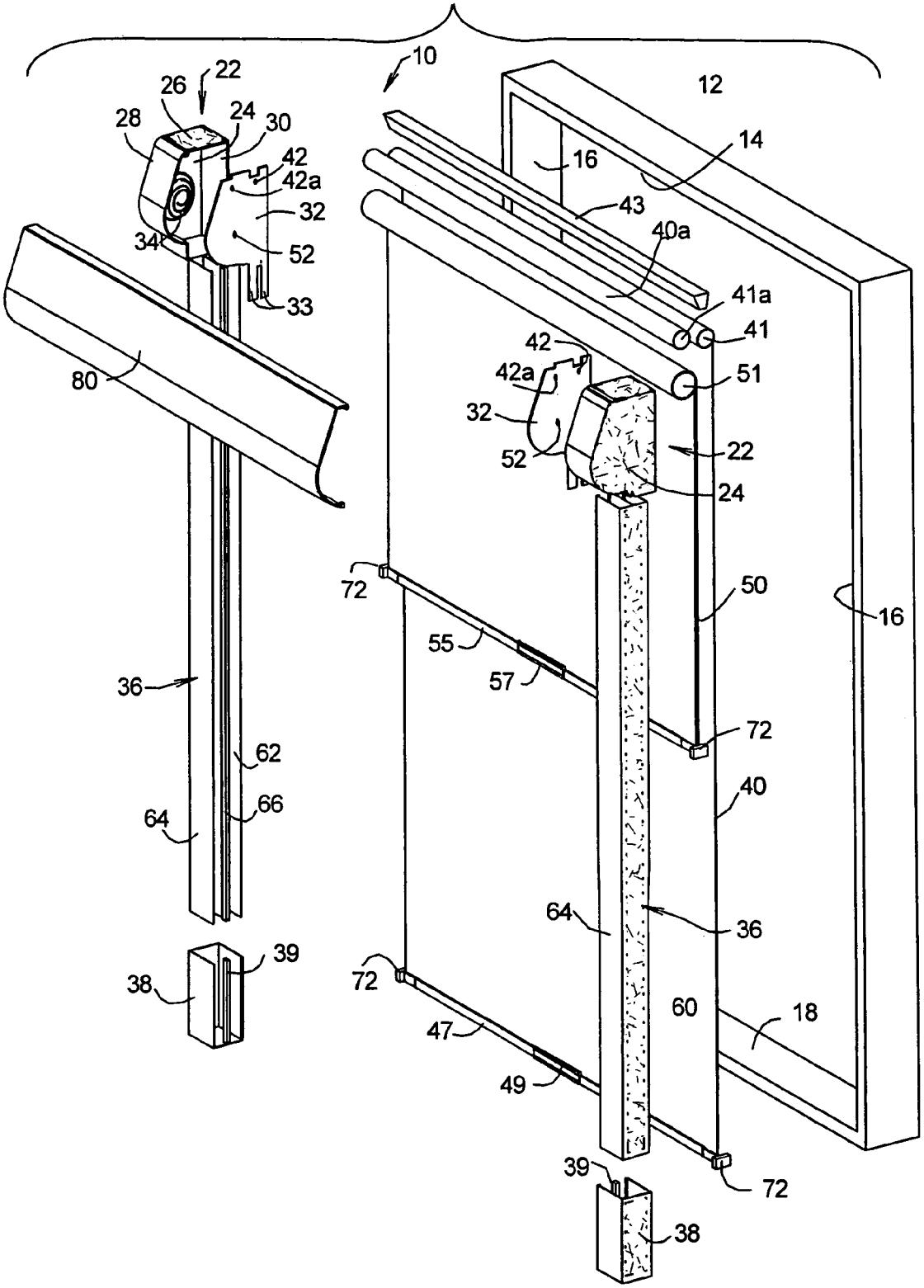
FIG. 2 is an exploded perspective view illustrating the several components of the shade system of the present invention.

In the illustrated embodiment, a shade system embodying the present invention is generally designated by the reference numeral 10 in FIGS. 1 and 2 and shown in relation to a residential dwelling window frame 12 having a top surface 14, side surfaces 16, a sill 18, and a window pane 20. As shown most clearly in FIGS. 2 and 3, the shade system includes a pair of end caps 22, each having a side wall 24, a top wall 26, a front wall 28, a bottom wall 29, and a back wall 30. Each of the top, front, and bottom and back walls 26, 20, 28, 29, and 30 project at right angles from the side wall 24 to provide a receptacle-like configuration in each end cap 22 that is open on the inside and through the bottom wall 29 thereof.

A pair of shade supporting plates 32 are securable in the respective end caps 22, each to engage a conical, coiled, compression spring 34 that is preferably fixed, such as by staking to the side wall 24 of each end cap 22. As may be seen in FIGS. 2 and 3, the shade supporting plates 32 have a profile that generally complements the interior of the end caps 22, and each have a pair of depending legs 33 that cooperate with upper ends of end rails as will be described in more detail below. Although the shade supporting plates 32 are spaced from the springs in FIG. 2 for clarity of illustration, in practice, they are preferably also attached to the spring 34 by staking to effect a pair of unitary assemblies, each including an end cap 22, a spring 34 and a shade supporting plate 32.

The illustrated shade system 10 further includes a pair of side rails 36, the top ends of which are receivable in the open bottom wall 29 of each of the end caps 22. The bottom ends of each side rail 36 telescope adjustably relative to a footer 38. As will be explained in more detail below, each of the footers 38 seats against the sill 18 and a side surface 16 of the window frame 12, and the side rail 36 extend from the footers 38 to each of the caps 22 when the end caps 22 are seated respectively against the top surface 14 and side surfaces 16 of the frame 12.

Also, surfaces of the respective end caps 22, side rails 36, and footers 38 that engage surfaces of the window frame 12 are provided with a layer of pressure sensitive adhesive depicted in FIG. 2 as lying within dotted line margins. Thus, side wall 24 and the top wall 26 of each end cap 22 is provided with a pressure sensitive adhesive so that mere placement of the end caps 22 under modest pressure into the upper corners of the frame 12 will result in an adhesive securement of the end caps to the side surfaces 16 and top surface 14 of the frame 12. Similarly, the side rails 36 and footers 38 are provided with such a pressure sensitive adhesive area on the surfaces that contact the side surfaces 16 and the sill 18 of the window frame. The pressure sensitive adhesive may be pre-applied to the indicated surfaces and covered by a removable blocking strip or may be provided by a double side adhesive tape applied to the indicated surfaces and similarly equipped with a removable blocking strip.

In accordance with the present invention, the shade system includes an impermeable, transparent shade and preferably a thermal insulating shade, each having a top portion connected to and wound on a roller mountable between the shade supporting plates, and a bottom end extendible from the roller to the sill. A pair of edge seals are supported within the at least one channel of the respective side rails, for slidably engaging and retaining opposite sides of the respective shade members in spaced relation to the window pane.

In the illustrated embodiment, the transparent shade is generally designated by the reference number 40 and the thermal insulating shade is so designated by the reference number 50. The transparent shade 40 is preferably formed from a polyester film, such as Mylar®, of a thickness in the range of 3 to 6 mills and treated with an ultraviolet (UV) inhibitor. The thermal insulating shade 50 is preferably a layered fabric of a thickness in the range of 100 to 140 mills, preferably about 130 mills. The layered fabric of the thermal insulating shade 50 preferably includes a decorative velvet-like or silk-like woven fabric to be presented on the inside of the window and bonded to a backing of white polyester film and five layers of carded latex bonded polyester. Both the make-up of the woven fabric material and decorative effect of the thermal insulating shade 50 may vary in warm or cool climates and/or arbitrarily as desired. Also, the length and width of both the transparent shade 40 and the thermal insulating shade 50 are the same for windows within a range of widths and heights as will be described in more detail below.

Figure 3:
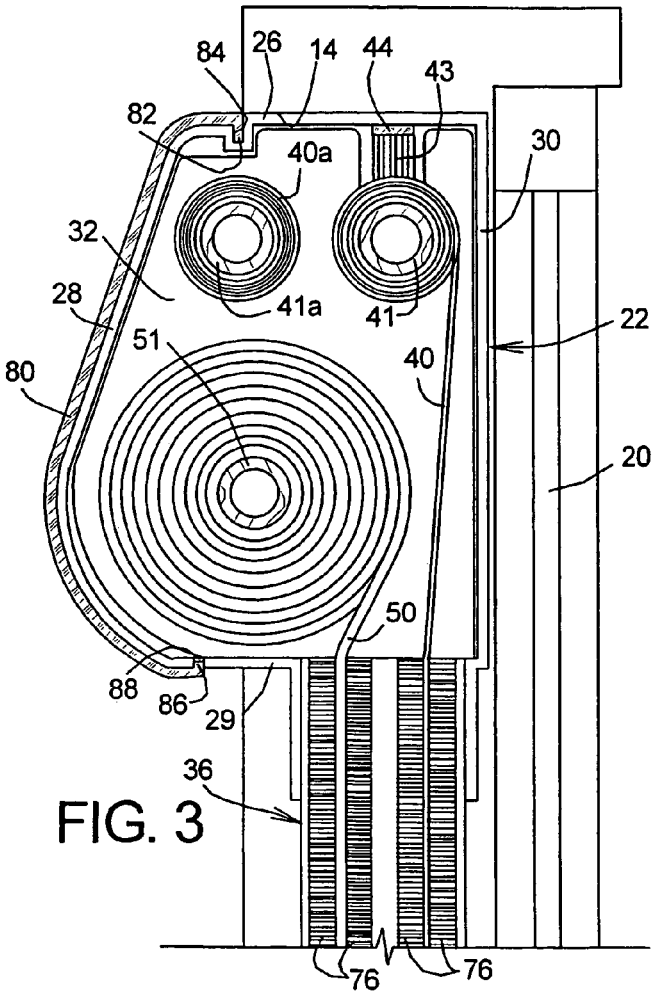
FIG. 3 is a fragmentary cross section on line 3—3 of FIG. 1.

As shown in FIGS. 2 and 3, the top end portions of each of the transparent shade 40 and thermal insulating shade 50 are connected to rollers 41 and 51, respectively and wound about those rollers in a complete or partially retracted condition of the respective shades. The rollers 41 and 51 are conventional, spring-return shade rollers of a length equal to the widths of the respective transparent and thermal insulating shades 40 and 50 and may vary in diameter. It is preferred that the diameter of the roller 41 is on the order of one inch and that the diameter of the roller 51 is somewhat larger to aid in a smooth roll of the thicker thermal insulating shade 50, for example, one and one-half inch. Both rollers 41 and 51 are also conventionally fitted with end pins that are mountable in apertures 42 and 52, respectively in the supporting plates 32. Although end pins for the roller 41 are not shown in the drawings, they are identical to the end pins 53 and 54 for the roller 51 for the thermal insulating shade 50 shown in FIGS. 6 and 7.

In accordance with the invention, the shade system includes means for sealing the transparent shade and the top surface of the rectangular window frame, and means for sealing the distal end of the transparent shade and the sill of the frame.

In the illustrated embodiment, and as shown in FIGS. 2 and 3, a deep pile sealing strip 43 having a pressure sensitive adhesive base 44 is securable against the top surface 14 of the window frame 12 and extends into contact with the outermost convolution of the transparent shade 40 wound on the roller 41. The sealing strip 43 is preferably of a length equal to the width of the transparent shade. The depth of the pile on the sealing strip 43 is selected to accommodate changing diameters of the wound top portion of the transparent shade 40 as it is drawn to the sill 18 of the window frame.

Figure 5:
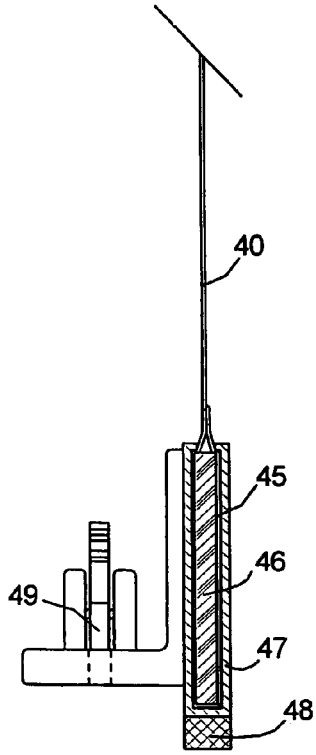
FIG. 5 is a fragmentary cross section on line 5—5 of FIG. 1.

As shown in FIG. 5, the bottom of the transparent shade 40 is formed with a hem loop 45 that receives a batten 46 of a length to extend completely across the width of the shade 40. The batten 46 is preferably formed of wood, plastics such as nylon, or other comparable materials and has a cross-sectional dimension approximating ⅛ inch by 1 inch. A channel shaped clip 47 of a length substantially equal to the width of the transparent shade 40 is secured over the hem 45 and batten 46. A foam insulating strip 48 is affixed to the bottom side of the clip 47 preferably by pressure sensitive adhesive. Thus, when the transparent shade 40 is fully drawn, the insulating strip 48 seals against the sill 18 of the window frame 12. A handle and latch assembly 49 is secured to the batten 46 through the inner side of the clip 47 and hem 45 by screws or rivets (not shown) to facilitate drawing of the transparent shade 40 and to secure the batten 46 to the sill 18.

A second transparent shade 40*a* is supported on a roller 41*a* mounted in apertures 42*a* in the supporting plates 32. The construction of the transparent shade 40*a* is identical to that of the transparent shade 40. However, the transparent shade 40*a* is treated with a solar blocking tint, such as a blue-gray solar tint having a 60% shading factor. The transparent shade 40*a* is used in place of the transparent shade 40 in windows facing the sun in climates or during seasons where air-conditioning is needed for cooling the residential dwelling in which the shade system 10 is employed.

Figure 6:
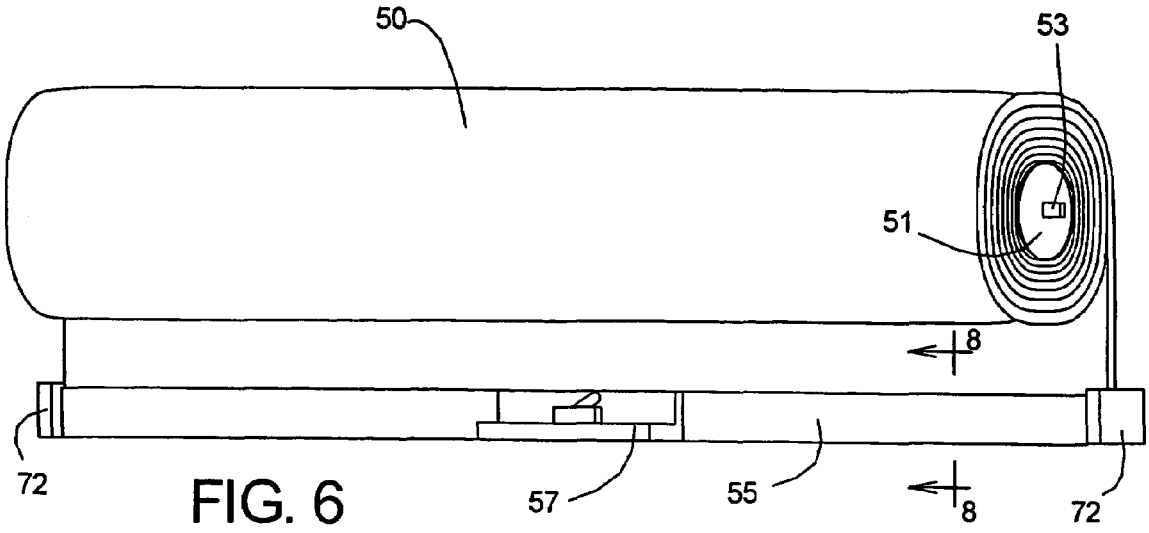
FIG. 6 is an isometric view illustrating one end of a thermal insulating shade of the invention.
Figure 7:
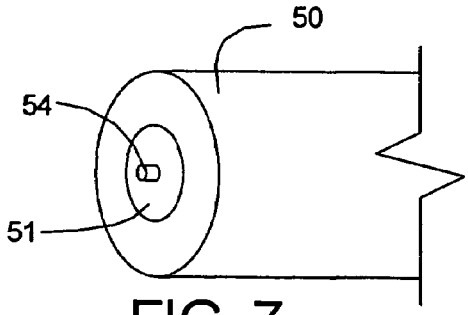
FIG. 7 is a fragmentary isometric view illustrating the other end of the thermal insulating shade show in FIG. 6.
Figure 8:
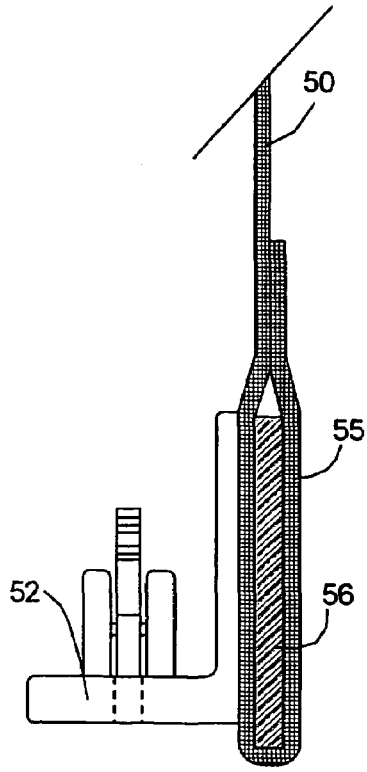
FIG. 8 is a fragmentary cross section on line 8—8 of FIG. 6.

The thermal insulating shade 50, as shown in FIGS. 6 and 8, also has a hem loop 55 that receives a batten 56, identical to the batten 46, that extends across the width of the thermal insulating shade 50. In this instance, the thickness and compressive characteristics of the material from which the thermal insulating shade 50 is made enables the hem portion thereof around the bottom edge of the batten 56 to be adequate for an effective seal with the sill 18. A handle and latch assembly 57 is also secured to the batten 56 through the inside of the hem loop 55 by screws or rivets (not shown).

In accordance with the present invention, shade edge seals are provided to prevent passage of air about the side edges of the transparent shade, and preferably, also about the side edges of the thermal insulating shade.

Figure 4:
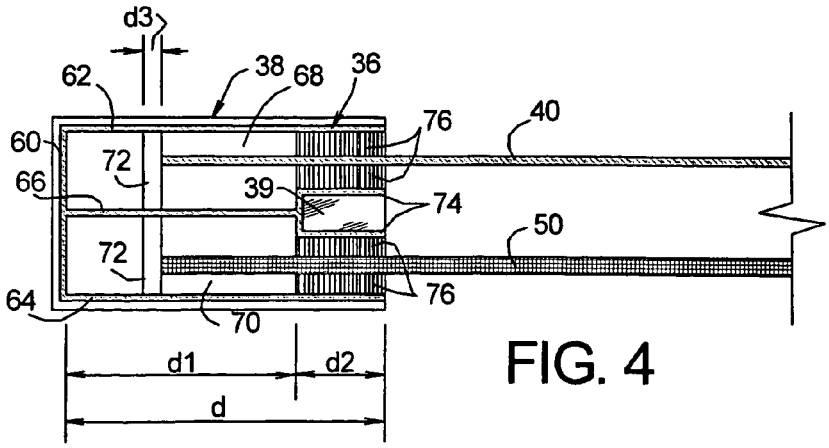
FIG. 4 is a fragmentary cross section on line 4—4 of FIG. 1.

In the illustrated embodiment, as shown in FIG. 2 and in more detail in FIG. 4, each of the side rails 36 is of generally E-shaped cross-sectional configuration to provide a base wall 60, an outer wall 62, an inner wall 64 and a central wall 66. The central wall 66 thus defines with the outer wall 62, an outer channel 68 and, with the inner wall, an inner channel 70. Each of the channels 68 and 70 has an overall depth d in a direction parallel to the walls 62, 64, and 66, and a channel width in a direction normal to that of the depth.

As shown in FIGS. 2, 4, and 6, guide blocks 72 are fixed to opposite ends of both the batten 46 of the transparent shade 40 and the batten 56 of the thermal insulating shade 50. Although the guide blocks 72 are shown to be generally rectangular in shape, other shapes, such as circular or elliptical shapes would function equally as well. The guide blocks are receivable in the respective channels 68 and 70 and, more particularly, in a guide portion of each such channel, the guide portion having a depth d1 from the base wall 60 of each of the side rails 36.

Each of the channels 68 and 70 also includes a sealing portion extending from the respective guide portions by a depth d2 as shown in FIG. 4. The sealing portions are defined in part by a bifurcated outer end portion 74 on the central wall 66 to reduce the channel width of the of the channel sealing portions relative to that of the channel guide portions of the channels 68 and 70. In this manner, the guide blocks 72, which have a depth d3, are prevented from lateral passage out of the guide portions of each channel 38 and 70. Also, the bifurcated end portions of the central wall 66 facilitate a complete telescopic connection of the side rails 36 and footers 38. As shown in FIGS. 2 and 4, the bottom ends of the side rails 36 fit within the footers 38. In addition, the footers 38 have upstanding posts 39 that telescope between the bifurcated end portions of the central wall 66, thereby to add stability to the connection.

Deep pile sealing strips 76 are secured, preferably by pressure sensitive adhesive, to each of opposite sides of the sealing portion of the respective channels 68 and 70. The pairs of sealing strips 76 in each channel 68 and 70 engage opposite sides of the transparent shade 40 and of the thermal insulating shade 50. Also, the pile on the sealing strips 76 is of a sufficient height to allow passage of the bottom edges of both shades 40 and 50, which, as described above and illustrated in FIGS. 5 and 8, are of increased thickness relative to the rest of the respective shades.

In accordance with the present invention, the shade system includes a valance to extend between the end caps, the valance having a length to overlie at least a portion of the front walls of the end caps in the widest of the range of frame widths and not exceeding the narrowest of the range of frame widths.

In the illustrated embodiment, as shown in FIGS. 1–3, a valance 80 of an end profile complementing the shape of the front walls 28 of the end caps 22 is provided to cover the rollers and other hardware components located near the top portion of the window frame 12. As shown most clearly in FIG. 3, the top of the valance 80 is formed with an in-turned lip 82 receivable in a slot form recess 84 in the top wall 26 of each of the end caps 22. Tabs 86 on the bottom edge and at opposite ends of the valance 80 clip into slots 88 near the bottom of the front walls 28 of the respective end caps 22.

As noted previously, the shade system of the present invention is capable of installation in window frames having a range of widths and heights. Wide ranges of frame widths and heights are accommodated by supplying shade system kits, each designed for an increment of window frame size range, for example, a width increment range of about 3 inches and a height increment range of 3–6 inches or more.

The height range increment is accommodated simply by a kit having shade lengths (i.e., the lengths of the shades 40, 40*a*, and 50) at least equal to the largest height of the range increment, and side rails 36 and footers 38 that telescope throughout the height range increment. Also, a measure of height range may be achieved by variable extension of the tops of the side rails 36 into the end caps 22. Alternatively, the side rails 36 of each shade system kit may be provided in lengths equal to the largest height of the height range increment and cut to length on site at the time of installation.

To accommodate a 3 inch width range increment of window widths, for example, the width of the shades 40, 40*a*, and 50, including the guide blocks 72, must be no greater than to the narrowest of the width range increment. Wider window frame widths within the width range increment are accommodated by the depth of the end caps 22 and side rails 36, that is, one half of the width range increment is accounted for on each of opposite sides of the window frame. Thus, and as shown in FIG. 4, for a 3 inch width range increment, the depth d1 of the guide portions of the channels 68 and 70 must be equal to 1½ inches, plus the depth d3 of the guide blocks 72. If the depth d2 of the sealing portion of the channels 68 and 70 is ⅜ inch, and the depth of the guide blocks 72 is ⅛ inch, the overall depth d of the guide rails 36 will be 2 inches.

Also, to accommodate the exemplary 3 inch width range increment, each of the supporting plates 32 must be capable of movement against the bias of the springs 34 through one half of the width range increment or through 1½ inches and must be supported by the end caps 22 throughout that range of movement. In the illustrated embodiment, the supporting plates 32 are supported by the bottom wall 29 of the end caps 22. Thus, for a 3 inch width range increment, the bottom wall 29 must extend from the side wall 24 of each end cap 22 by 1½ inches, plus the thickness of the supporting plates 32, plus the thickness of the spring 34 in its compressed or contracted condition. In this respect, the conical configuration of the springs 34 enables the spring wire convolutions thereof to be compressed to the thickness of one spring wire convolution, e.g., ⅛ inch or less. Assuming that the thickness of the supporting plates is ⅛ inch, at least the bottom wall 29 of the end cap must extend from the back wall 34 thereof by at least 1¾ inches.

Like the width of the shades 40, 40*a* and 50, the length of the valence 80 must be no greater than the narrowest of the width range increment and the depth of at least the front walls 28 of the respective end caps 22 must be adequate for the ends of the valence 80 to overlap at least a portion of the front walls 28 for wider widths. Thus, for the exemplary 3 inch width range increment and an overlap of ⅜ inch on each end of the valence 80, the depth of the front wall 28 of each end cap 22 must be at least 2⅛ inches. Also, the slots 88 must extend from the side wall 24 of each end cap 22 by the same distance as the front walls.

To install the shade system 10, the end caps 22 are first pressed into the upper corners of the frame 12 and secured by the pressure sensitive adhesive on the side walls 24 and top walls 26 thereof, respectively. The top of each side rail 36, with a footer 38 telescoped thereon, is inserted into the bottom opening of each end cap 22 so that the depending legs 33 on each supporting plate 32 extend into the top portion of each of the channels 68 and 70. Beginning at the top end portion of each side rail 36, the base wall 60 is pressed against the side surface 16 of the window frame 12, progressing to the bottom end thereof. When the bottom portion of the side rail 36 is secured adhesively to the side surface 16, the footer 38 is appropriately extended and pressed against the side surface 16 and the sill 18 of the frame. The shades 40, 40*a*, and 50, while fully wound on their respective rollers, are inserted into the apertures 42, 42*a*, and 52, respectively, in the supporting plates 32. The guide blocks 72 on each of the shades 40, (or 40*a*) and 50 are fed into the top ends of the respective side rail channels 68 and 70 and at least partially drawn down though those channels. The valence 80 is then affixed to the end caps 22. To complete the thermal shade installation, at least the transparent shade 40 or 40*a* is fully drawn and latched to the sill 18 to ensure a dead air space between it and the window pane 20.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An energy saving shade system for residential dwelling windows, each window having a window pane and a rectangular frame defined by top, side, and sill surfaces, the shade system being configured to be used with windows of various sizes and comprising:

a pair of shade supporting plates;

at least one impermeable, transparent shade, the at least one transparent shade having a top portion connected to and windable on a roller mountable between the pair of shade supporting plates, and the at least one transparent shade including a bottom end extendible to accommodate a variety of window frame lengths;

a pair of end caps, each end cap configured to be positioned in sealing relation against the top surface and one of the side surfaces of the frame, each end cap configured to receive one of the pair of shade supporting plates, a position of each of the shade supporting plates in its respective end cap being laterally adjustable to permit the shade system to accommodate a variety of window frame widths;

a pair of side rails, each side rail including a base configured to be secured in sealing relation against a respective side surface of the frame, and each side rail having an adjustable length to permit the shade system to accommodate a variety of window frame lengths, each side rail further including at least two generally parallel walls projecting from the base to define at least one channel extending along the length of the side rail, the at least one channel having an opening opposite the base, the opening configured to receive an edge of the at least one transparent shade, wherein the side rails each have an E-shaped cross-section to provide the base securable in sealing relation to the respective side surfaces of the frame, a pair of generally parallel outer walls projecting from the base, and a central wall projecting from the base in generally parallel relation to and defining with the outer walls, inner and outer channels opening to face inwardly of the respective side surfaces of the frame, and wherein the central wall of each side rail has a bifurcated inner edge;

a pair of side rail footers securable to the sill, each of the side rail footers and the respective side rails being telescopically adjustable through the range of frame heights, wherein each footer has an upstanding post receivable in the bifurcated edge of the central wall;

a pair of edge seals, each edge seal being supported within the at least one channel of a respective side rail, each edge seal being configured to slidably engage and retain a side portion of the shade member in spaced relation to the window pane;

a thermal insulating shade having top, bottom, and side edge portions, the top portion of the thermal insulating shade being connected to a second roller mountable between the shade supporting plates, and being wound on the second roller in a retracted condition, the bottom portion of the thermal insulating shade being extendable from the second roller to the sill surface of the window frame to position the thermal insulating shade in substantially parallel spaced relation to the transparent shade;

means for sealing the transparent shade and the top surface of the window frame; and means for sealing the distal end of the transparent shade and the sill.

2. The shade system of claim 1 comprising a valance to extend between the end caps, the valance having a length sufficient to overlie at least a portion of the front walls of the end caps to accommodate a variety of window frame widths.

3. The shade system of claim 1, wherein the means for sealing the transparent shade and the top surface of the rectangular frame comprises a deep pile strip securable to the top surface of the frame and engageable with the wound top portion of the transparent shade.

4. The shade system of claim 1, wherein the transparent shade is drawn through the outer channel and the thermally insulating shade is drawn through the inner channel.

5. The shade system of claim 1, wherein each of the inner and outer channels has a channel depth in a direction parallel to the outer and central walls of the respective side rails, and a channel width normal to the channel depth, each of the channels having a guide portion extending from the base by at least one half the range of frame widths, and a sealing portion extending from the guide portion.

6. The shade system of claim 5, wherein the channel width of the guide portion is greater than the channel width of the sealing portion.

7. The shade system of claim 6, wherein each of the transparent shade and the thermal insulating shade includes a pair of guide blocks, one on each of opposite sides of the respective shades, the guide blocks having a width dimension greater than the channel width of the sealing portion of the respective inner and outer channels.

8. The shade system of claim 7, wherein the guide blocks are secured to opposite ends of a batten fixed to and extending across the bottom edge portion of the respective transparent and thermal insulating shades.

9. The shade system of claim 8, wherein the guide blocks each have a depth dimension and the guide portion of each of the inner and outer channels extends from the base by at least one half the range of frame widths plus the depth dimension of each guide block.

10. The shade system of claim 5, including deep pile sealing strips on opposite sides of the sealing portion of the respective channels.

11. The shade system of claim 1, including a pair of side rail footers securable to the sill, each of the side rail footers and the respective side rails being telescopically adjustable through the range of frame heights.

12. The shade system of claim 1, including a pair of springs, each for biasing one of the pair of shade supporting plates to a position spaced from a side wall of one of the pair of end caps.

13. The shade system of claim 12, wherein each of the pair of springs is fixed at opposite ends to a shade supporting plate and to an end caps, thereby to provide a pair of end cap/supporting plate units.

14. The shade system of claim 12, wherein each of the pair of springs includes conical spring-wire convolutions, thereby to be contractible to a width of one spring-wire convolution.

15. The shade system of claim 1, wherein side and top walls of each of the end caps includes a pressure sensitive adhesive for securing each of the end caps to the side and top surfaces of the frame.

16. The shade system of claim 1, wherein the base of each of the side rails includes a pressure sensitive adhesive for securing each of the side rails to the side surfaces of the frame.

17. The shade system of claim 1, wherein the means for sealing the distal end of the transparent shade and the sill comprises a foam strip secured to the bottom end of the transparent shade.

18. The shade system of claim 17, including a hem along the bottom end of the transparent shade, a batten in the hem, and a channel-shaped clip overlying the hem and the batten, the foam strip being adhesively secured to the channel-shaped clip.

19. The shade system of claim 1, wherein the transparent shade is treated with an ultraviolet inhibitor.

20. The shade system of claim 19, wherein the at least one transparent shade is a first transparent shade, and further including a second transparent shade treated with a reflective solar tint, the second transparent shade being storable between the supporting plates and being interchangeable with the first transparent shade.

21. The shade system of claim 1, wherein the transparent shade is a polyester film treated with an ultraviolet inhibitor and the thermal insulating shade includes bonded layers including a decorative inner layer, an insulating fabric, an air tight layer, and a light filtering outer layer.

22. The shade system of claim 21, wherein the at least one transparent shade is a first transparent shade, and further including a second transparent shade formed of a polyester film treated with a reflective solar tint, the second transparent shade being storable between the supporting plates with the first transparent shade and the thermal insulating shade, and being interchangeable with the first transparent shade.

23. A method of installing a shade system, comprising:

providing a shade system comprising:

a pair of shade supporting plates, at least one impermeable, transparent shade, the at least one transparent shade having a top portion connected to and windable on a roller mountable between the pair of shade supporting plates, and the at least one transparent shade including a bottom end extendible to accommodate a variety of window frame lengths, a pair of end caps, each end cap configured to be positioned in sealing relation against the top surface and one of the side surfaces of the frame, each end cap configured to receive one of the pair of shade supporting plates, a position of each of the shade supporting plates in its respective end cap being laterally adjustable to permit the shade system to accommodate a variety of window frame widths, a pair of side rails, each side rail including a base configured to be secured in sealing relation against a respective side surface of the frame, and each side rail having an adjustable length to permit the shade system to accommodate a variety of window frame lengths, each side rail further including at least two generally parallel walls projecting from the base to define at least one channel extending along the length of the side rail, the at least one channel having an opening opposite the base, the opening configured to receive an edge of the at least one transparent shade, a pair of edge seals, each edge seal being supported within the at least one channel of a respective side rail, each edge seal being configured to slidably engage and retain a side portion of the shade member in spaced relation to the window pane, means for sealing the transparent shade and the top surface of the window frame, and means for sealing the distal end of the transparent shade and the sill;

pressing the end caps, each containing the shade supporting plate, into opposite upper corners of the window frame;

inserting a side rail into an opening in a bottom of each of the end caps;

adjusting a length of each side rail to fit the length of the window frame;

mounting the roller supporting the transparent shade between the shade supporting plates, the shade supporting plates moving laterally to receive the roller and shade;

drawing the bottom of the transparent shade downward toward the sill of the window frame such that sides of the shade travel through respective channels of the side rails; and sealing between the distal end of the transparent shade and the sill of the window frame.

* * * * *